US005484315A

United States Patent [19]

Juengst et al.

[11] Patent Number: 5,484,315

[45] Date of Patent: Jan. 16, 1996

[54] METHOD FOR PRODUCING A METAL-HALIDE DISCHARGE LAMP WITH A CERAMIC DISCHARGE VESSEL

[75] Inventors: Stefan Juengst, Zorneding; Stefan Kotter, Puchheim; Hartmuth Bastian, Feuchtwangen; Roland Huettinger, Jesenwang; Juergen Heider, Munich, all of Germany

[73] Assignee: Patent-Treuhand-Gesellschaft F. Elektrische Gluehlampen mbH, Munich, Germany

[21] Appl. No.: 211,608

[22] PCT Filed: May 6, 1992

[86] PCT No.: PCT/DE92/00372

§ 371 Date: Apr. 7, 1994

§ 102(e) Date: Apr. 7, 1994

[87] PCT Pub. No.: WO93/07638

PCT Pub. Date: Apr. 15, 1993

[30] Foreign Application Priority Data

Oct. 11, 1991 [DE] Germany ..... 9112690 U

[51] Int. Cl.[6] ..... H01J 9/32; H01J 9/38; H01J 9/40

[52] U.S. Cl. ..... 445/26; 445/29; 445/43

[58] Field of Search ..... 445/26, 43, 29; 228/60

[56] References Cited

U.S. PATENT DOCUMENTS

| | | | |
|---|---|---|---|
| 3,300,037 | 1/1967 | De Santis . | |
| 3,913,999 | 10/1975 | Clarke . | |
| 4,011,480 | 3/1977 | Jacobs et al. . | |
| 4,065,691 | 12/1977 | McVey | 313/174 |
| 4,208,605 | 6/1980 | McVey et al. . | |
| 4,342,938 | 8/1982 | Strok . | |
| 4,376,905 | 3/1983 | Kerekes . | |
| 4,545,799 | 10/1985 | Rhodes . | |
| 4,560,357 | 12/1985 | Bouchard et al. | 445/26 |
| 4,808,881 | 2/1989 | Kariya et al. . | |
| 5,098,326 | 3/1992 | Gorczyca et al. | 445/26 |
| 5,192,239 | 3/1993 | Graser . | |

FOREIGN PATENT DOCUMENTS

| | | | |
|---|---|---|---|
| 0034113 | 8/1981 | European Pat. Off. . | |
| 0136505 | 4/1985 | European Pat. Off. . | |
| 0451362A2 | 10/1991 | European Pat. Off. . | |
| 2548732C2 | 5/1976 | Germany . | |
| 3012322 | 10/1980 | Germany . | |
| 0272930 | 6/1988 | Germany . | |
| 60-72137 | 4/1985 | Japan | 445/26 |
| 60-079639 | 5/1985 | Japan . | |
| 62-234841 | 10/1987 | Japan | 445/43 |
| 494518 | 10/1938 | United Kingdom | 228/60 |
| 1465212 | 2/1977 | United Kingdom . | |
| 2072939 | 10/1981 | United Kingdom . | |

*Primary Examiner*—Kenneth J. Ramsey
*Assistant Examiner*—Jeffrey T. Knapp
*Attorney, Agent, or Firm*—Frishauf, Holtz, Goodman, Langer & Chick

[57] ABSTRACT

A method for producing a metal-halide discharge lamp with a ceramic discharge vessel is distinguished in that first both ends (*6a*, *6b*) are equipped with electrode systems and sealed off, but a filling bore (15) remains in the vicinity of the pump end (*6a*) and is not closed until after the filling.

22 Claims, 9 Drawing Sheets

METHOD FOR PRODUCING A METAL-HALIDE DISCHARGE LAMP WITH A CERAMIC DISCHARGE VESSEL

FIELD OF THE INVENTION

The invention relates to a method for producing metal-halide discharge lamps with a ceramic discharge vessel.

BACKGROUND

Metal halide discharge lamps typically have a discharge vessel of quartz glass. Recently, however, attempts have been made to improve the color rendition of these lamps. The higher operating temperature that this requires can be achieved with a ceramic discharge vessel. Typical output levels are from 100 to 250 W. The ends of the tubular discharge vessel are typically closed with cylindrical ceramic end plugs, into the middle of which a metallic power lead-through is inserted.

A similar technique is employed with high-pressure sodium vapor lamps. Both tubular and pronglike versions made of niobium are known (British Patent 1 465 212 Rigden and U.S. Pat. No. 4,376,905, Kerekes which are fused into a ceramic end plug by means of glass solder or melt ceramic. Direct, glass-solder-free sintering for nioblum/tubes has also been described (U.S. Pat. No. 4,545, 799, Rhodes et. al. The special feature of high-pressure sodium vapor discharge lamps is that the filling includes sodium amalgam, which is often contained in a reservoir in the interior of a niobium tube used as a lead-through. An especially simple possibility for filling and evacuating the discharge vessel is for one of the two niobium tubes to have a small opening in the vicinity of the electrode shaft mounted on the tube, in the interior of the discharge vessel, so that evacuation and filling with the amalgam and inert gas can be done through this opening (U.S. Pat. No. 4,342,938, Strok). After the filling process is concluded, the outside protruding end of the niobium tube is closed in gas-tight fashion by pinching, followed by welding. Nevertheless, the opening in the vicinity of the electrode shaft always remains open, so that during operation communication between the interior of the discharge vessel and the interior of the lead-through tube, acting as a cold spot, will be assured.

A different closure technique for high-pressure sodium vapor lamps is known from U.S Pat. No. 4,011,480, Jacobs et. al. It uses tubular lead-throughs of tungsten, molybdenum or rhenium, which are fused in gas-tight fashion into the plugs with the aid of a ceramic cylindrical shaped part in the interior of the tube by means of melt ceramic. Pinching the outer tube/end after the filling process is concluded must then be omitted, because these metals, in contrast to niobium, are known to be very brittle and can therefore be machined only with difficulty. The closure techniques that are known for niobium tubes cannot therefore be readily adopted. Instead, the ceramic shaped part is equipped with an axial bore, which during evacuation and filling cooperates with an opening in the tube in the vicinity of the electrode shaft. After the filling, the axial bore of the shaped part is closed with melt ceramic, making machining of the brittle molybdenum-like metal unnecessary. However, this technique is very inconvenient and therefore expensive and time-consuming.

THE INVENTION

The object of the present invention is to provide a method for producing a metal-halide discharge lamp with a ceramic discharge vessel.

Briefly, and particularly to provide hermetically sealed current lead-throughs into a discharge volume of a ceramic discharge vessel in which the lead-throughs may be brittle, the invention provides for a number of method steps, as follows:

Two electrode systems are first provided, which include an electrode and a sealing means. The two outer ends of the discharge vessel are equipped with the electrode elements, one, usually called the blind end, is hermetically gas-tightly sealed. The other end, called the pump end, has its electrode element sealed therein while leaving a filling bore through which the interior of the discharge volume can be evacuated, and then filled with a suitable gas fill, while also being supplied with fill additives, for example metallic additives. The discharge vessel is, thus, evacuated and filled through the filling bore. The additive is a solid body which contains a metal halide. Thereafter, that is, after the gaseous as well as solid fill has been introduced into the discharge vessel, the filling bore is closed and sealed in gas-tight fashion, for example, by slowly heating the region of the bore over a large surface area so as not to crack or disturb the ceramic discharge vessel.

When the lead-through technique known from high-pressure sodium vapor lamps is adopted for the lamps of the invention, it must be remembered that the halides attack both the melt ceramic and the metallic lead-through.

For this reason, when niobium or niobium-like metals (such as tantalum) are used, care must be taken to suitably shield the lead-through from the aggressive fillings. When molybdenum or molybdenum-like metals (such as tungsten, rhenium) are used, this problem does not arise, because these materials are substantially more corrosion-resistant, which is why in certain embodiments of the lead-through, molybdenum is preferred as the material. This applies primarily to tubular lead-throughs, while with pronglike lead-throughs there are no particular attendant advantages.

The specific form of the gas-tight seal of the lead-through at the end of the discharge vessel, for instance provided by means of an essentially ceramic plug or by means of a metal covering cap (U.S. Pat. No. 4,208,605, McVey et. al. ), is of secondary importance for the present invention. It may be made for instance by means of glass solder or melt ceramic, or by means of direct sintering.

Although the method of the invention is suitable for both niobium-like and molybdenum-like lead-throughs, in several embodiments it achieves its special value for molybdenum-like, that is brittle, materials, since it averts a strain on the material in terms of ductility. The present application therefore addresses in particular the problem of how brittle lead-throughs can be machined and how the evacuation and filling of a discharge vessel can be designed in such a way that even brittle molybdenum-like materials can be used.

A known sealing technique for high-pressure sodium vapor lamps (U.S. Pat. No. 5,192,239, Grasser) comprises closing the first end of the discharge vessel, then in a glove box evacuating the discharge volume through the second, still-open end, and providing it with the filling. After that, the second end is equipped with an electrode system and closed by heating; the first end must be cooled to prevent the filling from escaping. However, this method is rather complicated, timeconsuming and expensive, because the two ends are sealed at different times, and moreover a glovebox is needed.

The method of the invention excels by comparison in that both ends of the ceramic discharge vessel are equipped with electrode systems that are subsequently sealed off by heating, either by melting a melt ceramic or by direct sintering. Hereinafter, the electrode system which is understood to be a premounted component that comprises the electrode (shaft and tip) is secured to the lead-through, for instance by butt-welding; the lead-through itself is inserted into the sealing means (typically a ceramic end plug). Under some circumstances the lead-through may be inserted in sunken fashion on one or both ends of the plug, and in addition an external electric power lead may be secured to the lead-through. The lead-through may also itself take on the task of the sealing means.

Upon being heated, one end, formed as a blind end, is then completely sealed. The type of lead-through used there is not essential to the present invention. The other end is likewise largely sealed off, but only to such an extent that it can still serve as a pump end; that is, an additional filling bore is initially left open and connects the discharge volume with the external space located in a glovebox; optionally, the bore may also be connected directly via a coupling with supply lines for evacuation and/or filling. The advantage of this method is that cooling of the blind end when the filling bore is sealed becomes largely unnecessary, making it possible to shorten the structural length of the lamp considerably. The expenditure of energy for closing the filling bore is in fact only a fraction of the requisite heat supplied for sealing the electrode system.

In a first embodiment, the bore may be made in the side wall of the discharge vessel itself, or in a second and third embodiment it may be made in the electrode system (sealing means or lead-through).

The advantage of the first embodiment is that during lamp operation the thermal load in the region of the side wall is markedly less than in the region of the electrode system, so that a simple melt ceramic (or glass solder) may be used for sealing purposes. The lead-through on this end may be pronglike or tubular.

In the second embodiment, the bore is made in the sealing means outside the lamp axis. This design is especially favorable for a pronglike lead-through and for a plug made of cermet; a melt ceramic with as high a melting point as possible should be used for sealing. However, this design may also be employed with a tubular lead-through.

An especially elegant version is attained by means of a third embodiment. Here the lead-through is tubular, and the filling bore is located in the vicinity of the electrode shaft, in a part of the lead-through that is oriented toward the discharge volume. The bore joins the discharge volume to the interior of the tubular lead-through. It is located either in the side wall of the tube or on the end of the tube.

This latter arrangement is especially advantageous because solid filling ingredients can especially easily pass through the vertically oriented tube, including the filling bore, by the action of gravity, making the subsequent closure easier.

In all the embodiments, the filling bore serves to evacuate and fill the discharge volume; both the inert gas and the metal halide or halides and optionally metal to excess, each of which is in solid form (metal halide in the form of a compact, metal in the form of a length of wire or foil), may be introduced into the discharge volume through the bore. Next, the bore is closed directly or indirectly by heating. It must be remembered that if the filling bore is provided in ceramic material, particularly in the side wall or in the usually ceramic sealing means, it must be heated slowly and over a large surface area, for instance by means of a gas burner or a flared laser beam; otherwise, fissures would develop in the ceramic.

The third embodiment is especially advantageous from this standpoint, namely a tubular lead-through with a bore in the vicinity of the electrode shaft. If the bore is located in metallic material instead of ceramic material, it can be heated considerably faster and also in concentrated fashion, so that cooling of the blind end can be omitted entirely and the structural length of the lamp can be chosen to be especially short.

For the purpose of heating and closing, the focused beam of the laser that is threaded into the tube is especially suitable; an Nd-YAG laser with a wavelength of 106 μm is especially suitable. Laser heating can also be done through the wall of the discharge vessel, because the translucent ceramic material of this vessel does not absorb the 1.06 μm radiation.

In this way production can be simplified considerably, because less time and energy are needed to seal off the bore. The sealing is done either by means of a high-melting-point metal solder filled in previously (advantageously with a melting point not below 1700° C.) or by fusing the tube material itself. An especially preferred embodiment is closure by indirect heating, in that a filler rod adapted to the inside diameter of the tube and whose length is approximately equal to the length of the tube is introduced into the tube and welded to the end of the tube remote from the discharge. The advantage of this arrangement is the especially reliable sealing and the easy access to the welding point, which avoid the necessity of threading in a laser beam and enables better monitoring of the quality of the resultant seal. On the other hand, the solid filler rod represents a major expenditure of material. This rod is needed in order to eliminate the undesirable dead volume of the tube in metal-halide lamps, in contrast to high-pressure sodium vapor lamps. In the other embodiments of the method, in which the filling bore itself is closed, this dead volume is automatically eliminated.

In the production of the electrode system, the brittleness of a molybdenum-like lead-through material can especially make itself felt negatively. Above all, securing the electrode to the lead-through must then be considered as a critical step. The technique, known from niobium-like lead-through material, of butt-welding the electrode shaft to the end of the lead-through is advantageous with molybdenum-like material as well, if a solid prong is used as the lead-through. If tubular lead-throughs are used, however, the problem arises that with molybdenum-like material, the only semifinished goods that are available are tubes open on both ends. Because of the brittleness of the material, it was previously not possible to produce one-piece tubes closed on one end in the way that is conventional when niobium is used.

Instead, various alternative methods are proposed here. A first option is for the electrode shaft, whose diameter is considerably less than that of the molybdenum tube, to be introduced in centered fashion by means of a gauge into one end of the tube, and for the tube or at least its end surrounding the shaft then to be heated to approximately 400° C., and finally for the heated and hence now ductile molybdenum tube to be pinched around the electrode shaft and optionally mechanically fixed by means of spot welding. The sealing is done by a welding technique, particularly by aiming a heat source, especially a laser beam, at the pinch. Especially advantageously, the laser beam is focused on a point of the pinch, while the tube rotates about its own axis. Next, the filling bore is created laterally in the tube wall, in the vicinity of the electrode shaft, for instance by means of a single laser pulse of oblique incidence. Typically, this bore is a hole from 0.6 to 0.8 mm in size. This technique is very simple and very reliable. However, closing of the filling bore is then relatively complicated, because this bore is located markedly above the shaft end and therefore a larger quantity of metal solder must be used in order to fill the inner volume of the tube up to the filling bore.

A modification of this technique provides that simultaneously with the electrode shaft, by means of a gauge, a space-saver located parallel to it for the bore is introduced into the end of the molybdenum tube. Once the tube has been made ductile by being heated to 400° C., the tube end is pinched around the electrode shaft and at the same time around the space-saver for the bore (for instance, a prong or short length of tube), and the shaft is fixed. The space-saver is then removed, thereby creating the bore. When the pinch is sealed, in this modification rotation of the component is dispensed with, and only part of the pinch, which is located away from the bore, is made molten. In this technique, one production step (the separate production of the bore) can be saved. The bore is also located on the end of the tube in the vicinity of the axis, so that the later closure after the filling process is made considerably easier. First, the bore can be seen better with the laser beam, and second the sealing is better since the metal solder, which melts as a result of the laser heating, runs automatically into the filling bore under the influence of gravity and is reliably kept there by the capillary action of the hole, which is only from 0.6 to 0.8 mm in size. Moreover, compared with a lateral hole, only a slight quantity of metal solder is needed.

In a third variant, the tube end itself can serve as a filling bore; pinching is omitted. In a first embodiment of this variant, the adaptation of the diameter of the electrode shaft to that of the molybdenum tube is done by melting the electrode shaft end back and as a result making it rounded. The diameter of the rounded shaft end, which is determined by the length of the melted-back portion of the shaft, is selected such that it is approximately adapted to the inside diameter of the tube. Not until then is the rounded shaft end introduced into the tube, and mechanically fixed (by spot welding) and the tube end welded to the shaft and thereby sealed off. Once again this can be done by laser welding by aiming a focused laser beam at the tube end and rotating the component comprising the shaft and tube about its axis. After that, a lateral filling bore can again be created, for instance by mechanically producing a hole or by aiming a laser from outside at the tube wall in the vicinity of the tube end. Originally, this version appeared unsuccessful because given what seemed to be the approximately vertical arrival of the laser at the tube wall—at right angles to the tube axis and intersecting it—the amount of rejects was very great because the rear wall was simultaneously drilled through as well. It was uneconomical to close off this kind of double bore. Instead, the laser is aimed obliquely at the tube wall, which averts making a second bore. The laser may also be allowed to arrive at right angles to the tube axis, but offset laterally from it, and thus to cut a transverse slit.

In a second embodiment of this variant, the electrode shaft is first tacked to the inner wall of the tube, and a slight shifting of the electrode shaft out of the lamp axis is intentionally taken into the bargain. The opening that remains at the tube end is used as a filling bore. Subsequently, the molybdenum tube, including the filling bore, is closed off by a filler rod that suitably has a recess for the electrode shaft. The filler rod is joined to the tube, as already described, on the end remote from the discharge.

This embodiment combines the advantages of the techniques described thus far in an especially advantageous way, because both producing a separate filling bore and pinching the tube end in order to hold the electrode shaft are avoided in an elegant way. Making the electrode shaft rounded is also unnecessary.

The methods described are also suitable for niobium tubes. In the pinching process, prior heating can be dispensed with, however.

DRAWINGS

The invention is described below in terms of a plurality of exemplary embodiments. Shown are:

FIG. 1, a metal-halide discharge lamp, partially in section;

FIG. 2, a second exemplary embodiment of the region of the pump end of the lamp, partially in section;

FIG. 3, a third exemplary embodiment of the region of the pump end of the lamp, partially in section;

FIGS. 4 and 5, exemplary embodiments for the closure of a tubular lead-through;

FIGS. 6–8, exemplary embodiments for securing an electrode shaft to a tubular lead-through;

FIG. 9, an exemplary embodiment of the region of the pump end of a lamp with a cermet plug.

DETAILED DESCRIPTION

Figure 1:
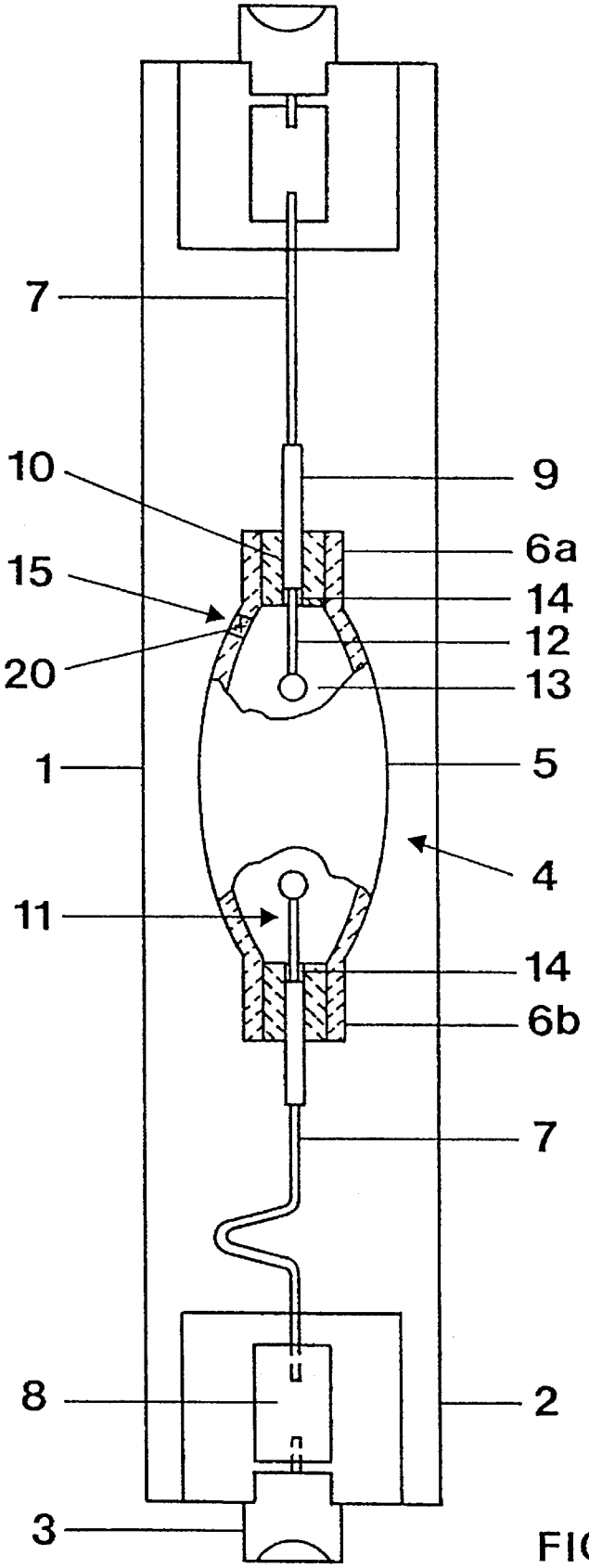

FIG. 1 schematically show a metal-halide discharge lamp with an output of 150 W. It comprises a cylindrical outer bulb 1, defining a lamp axis, of quartz glass with pinches 2 and bases 3 on both ends. The axially arranged discharge vessel 4 of $Al_2O_3$ ceramic bulges in the middle 5 and has cylindrical ends 6. It is retained in the outer bulb 1 by means of two power leads 7, which are joined to the base parts 3 via foil 8. The power leads 7 of molybdenum are welded to pronglike lead-throughs 9, which are each sintered directly, in other words without glass solder, into a ceramic end plug 10 of the discharge vessel.

The two lead-throughs 9 of niobium (or molybdenum) each retain an electrode 11 on the discharge side; the electrode comprises an electrode shaft 12 of tungsten and a spherical tip 13 formed on the discharge end. The filling of the discharge vessel comprises not only an inert, ignition gas such as argon, but also mercury and additives of metal halides.

In this embodiment, the electrode shaft 12 extends all the way into the axis bore in the end plug 10, because the pronglike lead-through 9, on the discharge side, is inserted in sunken fashion in the bore. On the other side, the prong 9 protrudes past the outer end of the end plug and is joined directly to the power lead 7.

In contrast to the blind end **6*b*, a filling bore 15 is provided in the vicinity of the pump end 6*a*; after filling, this bore is closed by means of a glass solder or a melt ceramic 20. One option for heating the additional filling bore 15**, which is provided with a melt ceramic composition, is to use a laser beam, flared in a special optical element, or a gas burner. In the process, the composition melts and is retained in the filling bore, which acts as a capillary, and cools there, thereby completing the sealing.

Figure 2:
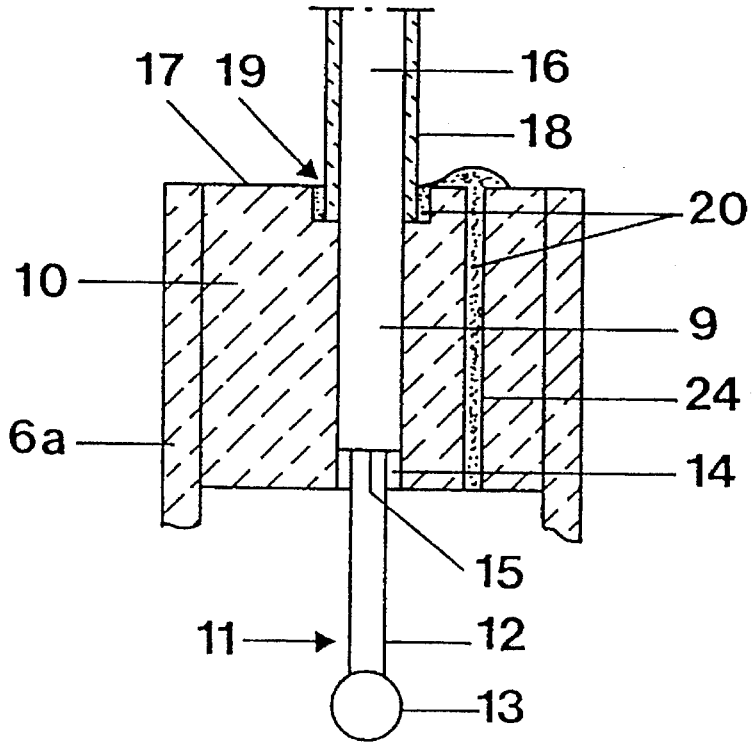

In FIG. 2, the region of the pump end **6*a* of the discharge vessel is shown in detail for a second exemplary embodiment. The discharge vessel has a wall thickness of 1.2 mm on both ends. The cylindrical plug 10 of $Al_2O_3$ ceramic, which is inserted into the end 6 of the discharge vessel, has an outside diameter of 3.3 mm and a height of 6 mm. A niobium prong 9 having a length of 12 mm and a diameter of 0.6 mm is sintered directly into the axial bore 14 of the plug to act as a lead-through. The electrode shaft 12 (diameter 0.55 mm) is butt-welded to the niobium prong 9**.

The outer segment 16 of the niobium prong is closely surrounded by a ceramic sheath 18. For better retention, the bore 14 is flared on the end 17 of the end plug remote from the discharge. The sheath 18 is inserted into this enlarged bore segment 19 and is fixed by the addition of a glass solder 20 at this point. The sheath is a precaution against graying and stabilizes the niobium prong, which becomes brittle as a result of the sintering.

In this case, the filling bore 24 is passed through the plug 10 parallel to the lamp axis but offset laterally from it. As already explained, it is sealed off with a high-melting-point ceramic 20 once the evacuation and filling process is concluded. Fusing in when the sheath 18 is secured and sealing off the filling bore 24 can advantageously be done in one step. To reduce the quantity of melt ceramic in the filling bore 24, an $Al_2O_3$ filler rod can be introduced into the filling bore 24.

Figure 3:
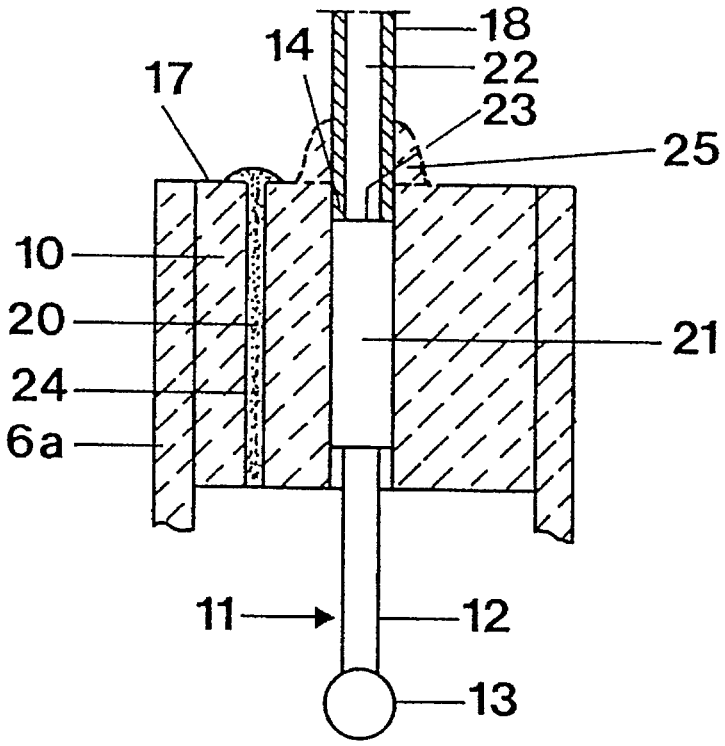

A particularly preferred embodiment is shown in FIG. 3. The difference from FIG. 2 is that the niobium prong 21, which has a length of 5 mm and a diameter of 0.8 mm, is located in sunken fashion on both ends in the opening 14, so that a sheath can intrinsically be dispensed with. The electrode shaft 12 of tungsten wire has a diameter of 0.75 mm and a length of 7 mm. It extends to a depth of 0.5 m into the opening 14. On the side 17 of the end plug 10 remote from the discharge, a tungsten wire, as a connecting part 22 of the external power supply, is also butt-welded to the prong 21. The connecting part 22 likewise has a wire diameter of 0.75 mm; its length is 11 mm. The seam 23 between the connecting part and the lead-through is also located at a depth of approximately 0.5 mm in the axial opening 14 of the end plug. Since because of the different coefficients of expansion contact between the tungsten prong 22 and the glass solder 20 in the filling bore 24 should be avoided, because this would otherwise cause fissures in the ceramic, once again a sheath 18 of niobium (or ceramic) is provided here, which advantageously surrounds the tungsten prong 22, because unlike tungsten or molybdenum, these two materials have a coefficient of expansion that is adapted to the melt ceramic 20. Instead of or in addition to the sheath, a collar 25 (shown in dashed lines) surrounding the tungsten prong 22 and formed onto the plug 10 may be used as a separator means.

Figure 4B:
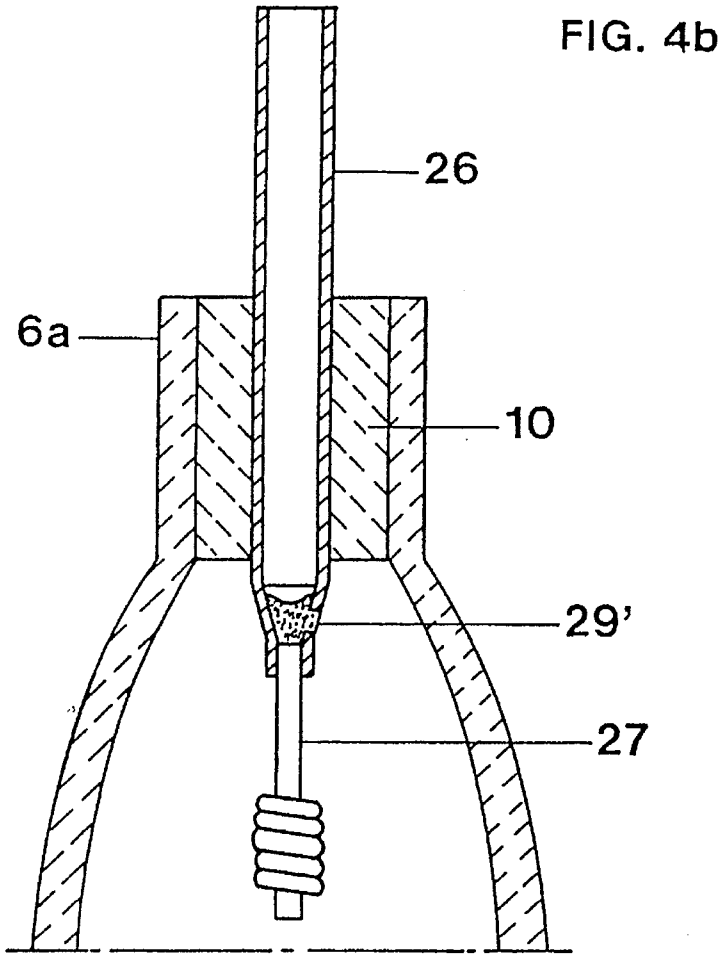
Figure 4A:
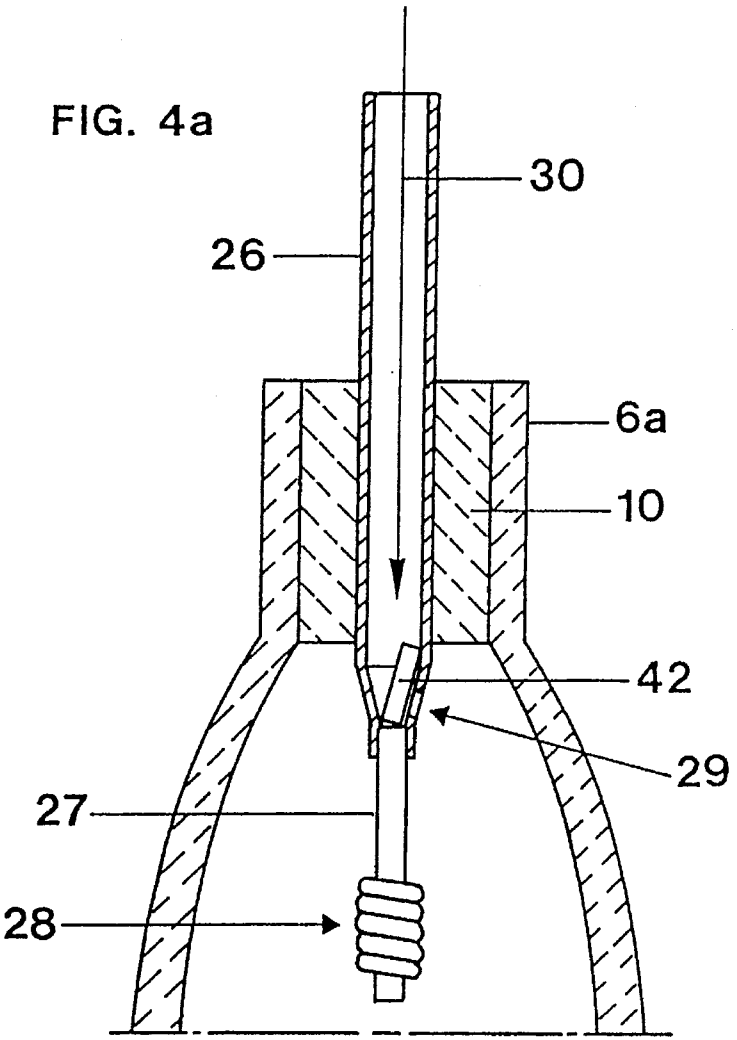

A further exemplary embodiment is shown in FIGS. 4*a* and 4*b*. A thin-walled molybdenum tube 26 is sintered directly into the plug 10 on the pump end 6*a*. On its end facing the discharge, a tungsten prong, in the form of an electrode shaft 27 with a helical part 28, is pinched in place and welded gas tight. The filling bore 29 is provided in the side wall of the tube in the vicinity of the electrode shaft 27. After the filling process, it is closed by the insertion of a metal solder compact 42 (titanium solder or a mixture of titanium and molybdenum or zirconium/molybdenum, for instance) or a wire segment of solder material (such as titanium or zirconium), which has a melting point of more than 1700° C., is inserted into the tube 26. A finely focused laser beam (Nd-YAG) 30 is directed into the tube in the tube axis and heats the metal solder 42 (FIG. 4*a*). The solder melts and seals the filling bore 29', which acts as a capillary (FIG. 4*b*). This kind of method is especially advantageous since melting of the solder is attained by a purposeful brief heating, so that in this exemplary embodiment, cooling of the blind end in whose vicinity the filling components are located can be dispensed with entirely during the closure of the pump end 6*a*, and therefore the structural length of such discharge vessels can be chosen as especially short.

Figure 5:
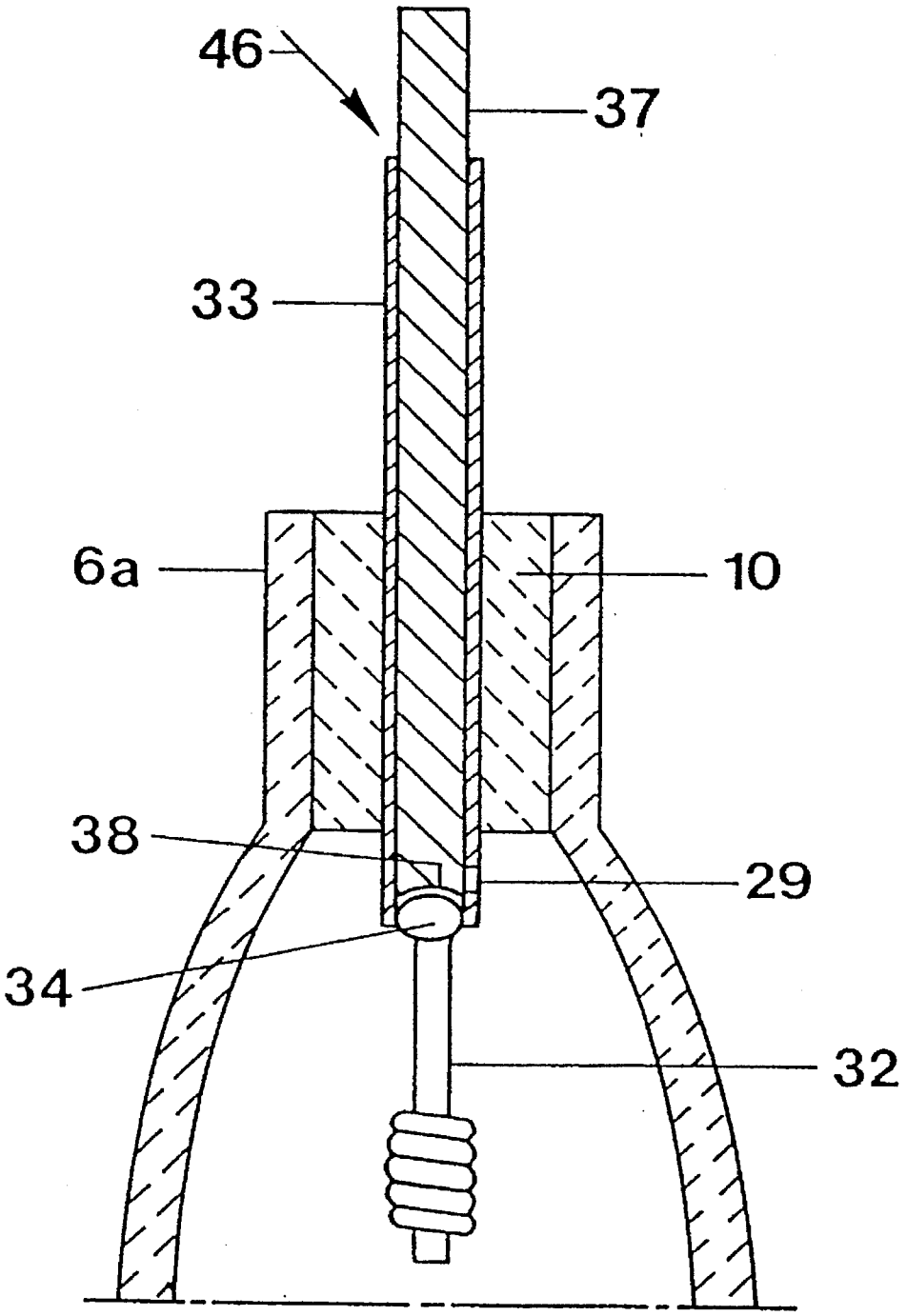

An additional exemplary embodiment is shown in FIG. 5. It corresponds substantially to the arrangement of FIG. 4, because once again a thin-walled molybdenum tube 33 is sintered directly into the plug 10 on the pump end 6*a*, and a tungsten prong is secured as an electrode shaft 32 to the tube end. The filling bore 29 in the side wall of the tube is closed mechanically, after the evacuation and filling of the discharge vessel, by introducing a filler rod 37, adapted to the inside diameter of the tube 26, into the tube 32 and thus filling the dead volume in the interior of the tube and in the process also covering the filling bore. In the case of a spherically thickened end 34 of the electrode shaft, the end toward the shaft may have a concave curvature 38 for the sake of better adaptation. The filler rod 37 of molybdenum or tungsten protrudes from the outer end of the tube 33 and is welded to the tube end there in gas-tight fashion, for instance by means of laser welding 46 or by means of a gas burner. A filler rod that is flush with the tube end or is countersunk in it somewhat may also be used.

Figure 6A:
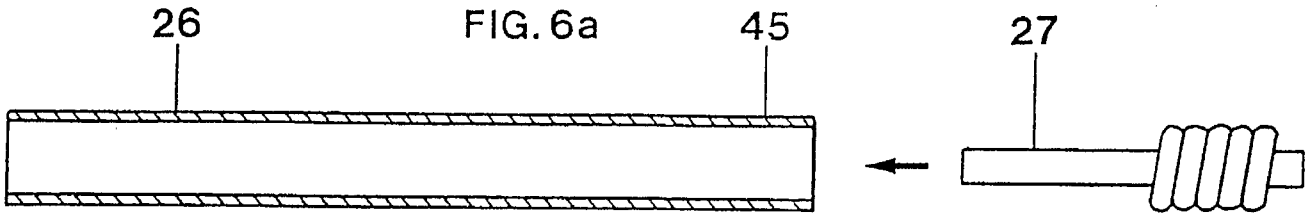
Figure 6B:
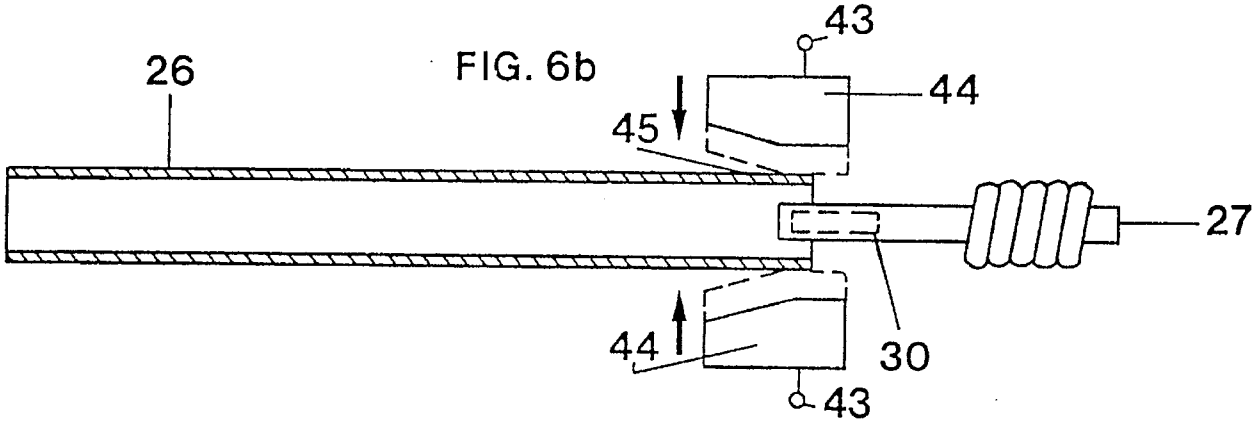
Figure 6C:
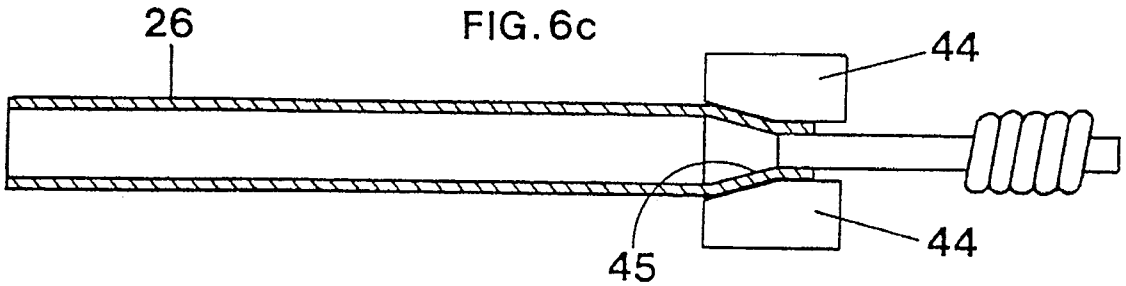
Figure 6E:
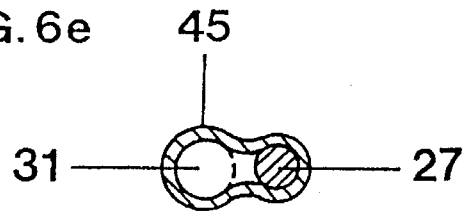
Figure 6D:
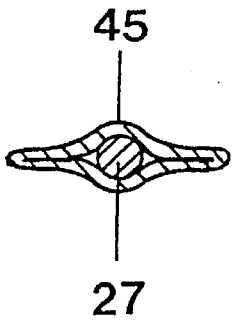
Figure 6F:
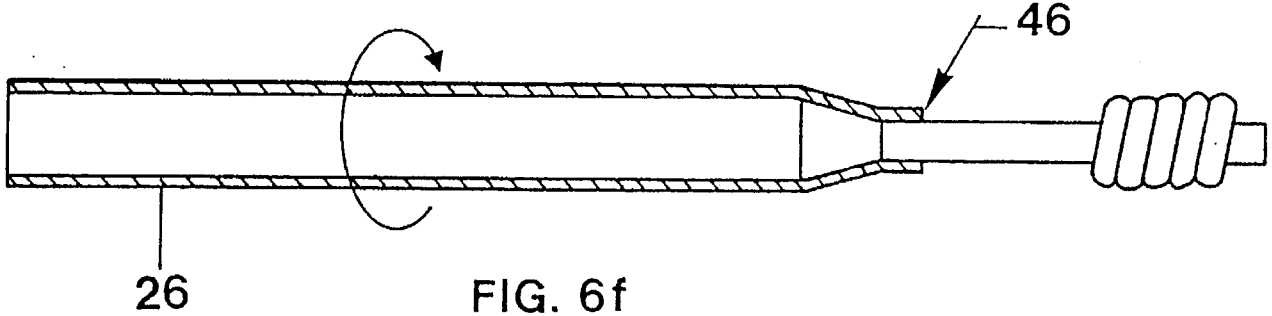
Figure 6G:
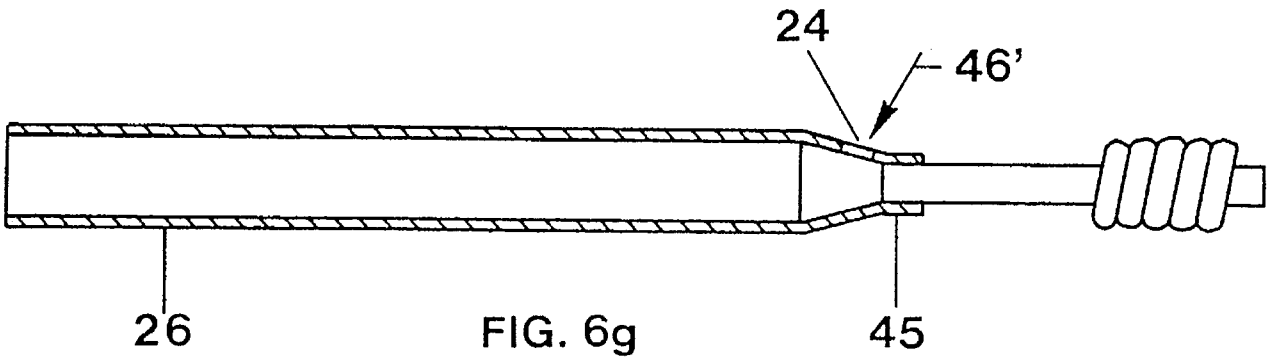

FIGS. 6*a*–6*g* show a first possibility for securing an electrode in a molybdenum tube. The molybdenum tube 26 has an wall . inside diameter of 1.3 mm and a wall thickness of 0.1 mm, for instance, while the electrode has a tungsten shaft 27 with a diameter of 0.5 mm. At first, the electrode shaft 27 is introduced, centered, approximately 1 mm deep into one end of the molybdenum tube 26 (FIG. 6*a*). Next, the tube 26 is heated by supplying heat to 400° C. (FIG. 6*b*), so that the intrinsically brittle material becomes ductile. This is especially advantageously achieved by positioning two pinching jaws 44 against the tube end 45 (as indicated by the arrow) and applying voltage 43 to them, so that the tube end 45 is heated by the passage of current effected by putting the pinching jaws 44 into contact (as indicated by dashed lines) with the tube end 45. Not until then is the heated tube end pinched around the electrode shaft 27 (FIG. 6*c*) by means of the pinching jaws 44, thereby producing an elongated cross section in the region of the tube end 45 (FIG. 6*d*). The shaft 27 is now fixed (tacked) within the tube by spot welding. Next, a laser beam 46 is aimed at the pinched tube end. With the tube in constant rotation (arrow), a welded connection is achieved that creates a gas-tight seal (FIG. 6*f*). Finally, a laser 46' is aimed obliquely at the tube 26 in the vicinity of the pinch, with the tube axis and the laser beam located in the same plane, and the filling bore 24 is created by a single pulse (FIG. 6*g*).

In a somewhat different embodiment, simultaneously with the electrode shaft (0.5 mm diameter) in a gauge, a prong of 0.6 mm diameter, located parallel to it, is introduced into the tube end as a space-saver 30 for the filling bore (this is shown in dashed lines in FIG. 6*b*). After heating and pinching of the tube (Figs. 6*b*, 6*c*), the space-saver 30 is removed again, so that besides the electrode shaft 27 here suitably provided outside the tube axis - an opening that serves as a filling bore 31 (FIG. 6*e*) remains at the end 45 of the tube 26. The electrode shaft 27 is tacked in the pinch without closing the filling bore 31. The tacking may also be done prior to the removal of the space-saver. In that variant, the method step of FIG. 6*g* is omitted. Immediate welding is not done. Instead, the final sealing takes place after filling, either by means of a metal solder or by means of a filler rod (FIG. 4 or 5).

Figure 7A:
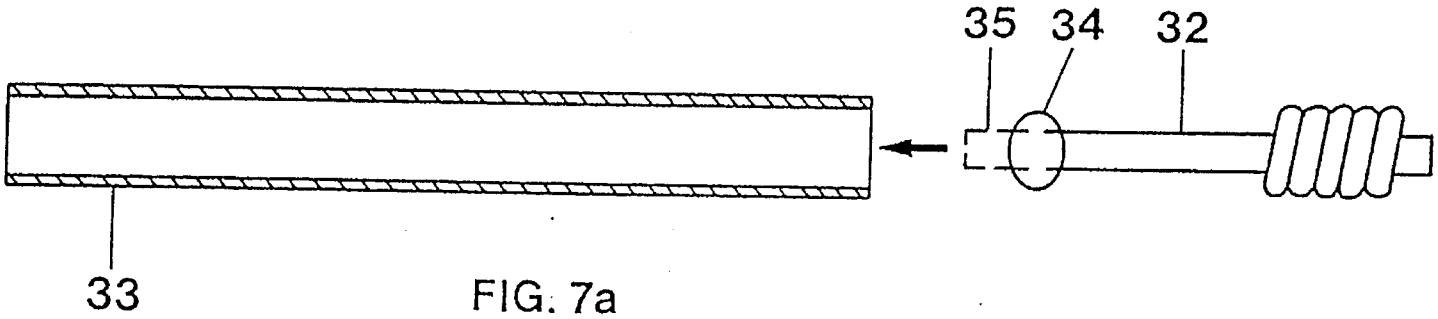
Figure 7B:
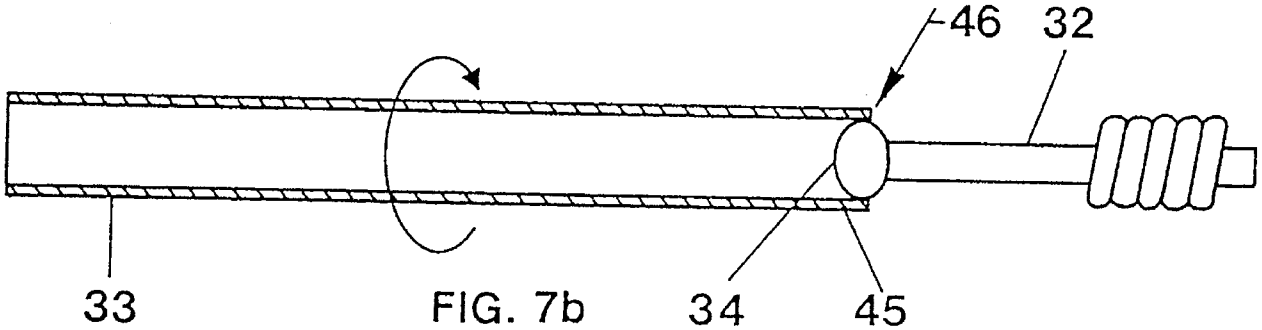
Figure 7C:
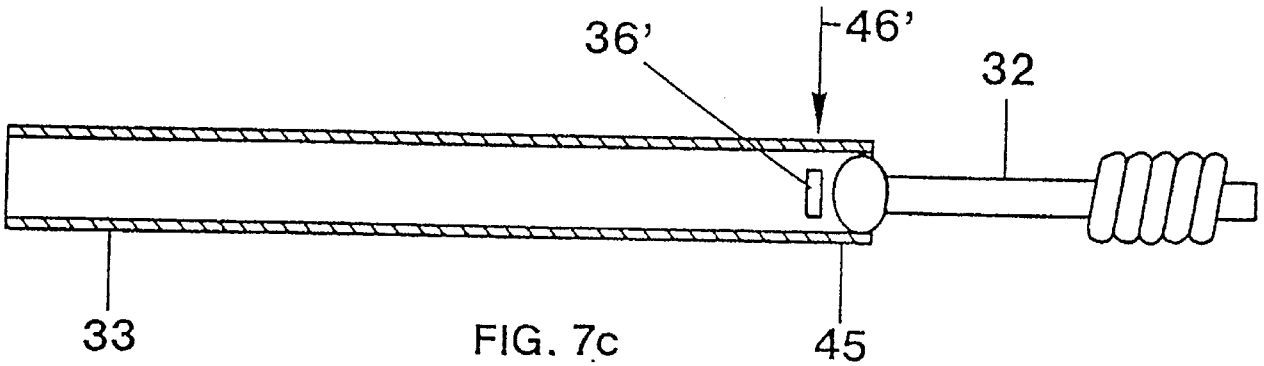

Another possibility for securing an electrode in a molybdenum tube will be explained in conjunction with FIGS. 7*a*–7*c*. First (FIG. 7*a*), the electrode shaft 32, whose diameter is again considerably less than the inside diameter of the molybdenum tube 33, is melted back on one end by supplying heat, to such an extent that a rounded end 34 is created, whose outside diameter is adapted to the inside diameter of the molybdenum tube 33. The length of the melted-back shaft segment 35 determines the diameter of the rounded end 34. Then the rounded end 34 is introduced (arrow) into the tube end and tacked there (for instance by laser or spot welding). The tube end 45 can now again be sealed, if desired, for instance by laser welding 46; advantageously, the tube 33 is rotated about its axis in the direction of the arrow (FIG. 7*b*). Next, the filling bore 36' is produced, by aiming a laser 46' at the tube end 45, shortly after the welding point, at right angles to the tube axis but offset laterally from it, and by creating a transverse slit 36' approximately 0.7 mm wide in the tube wall with a single laser pulse (FIG. 7*c*).

Figure 8B:
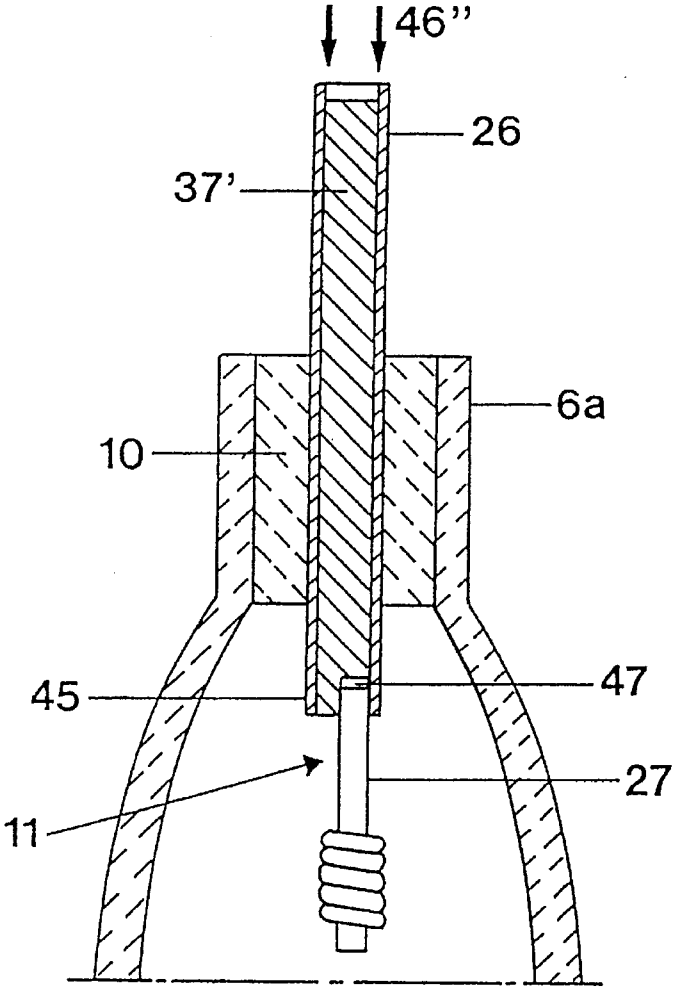
Figure 8A:
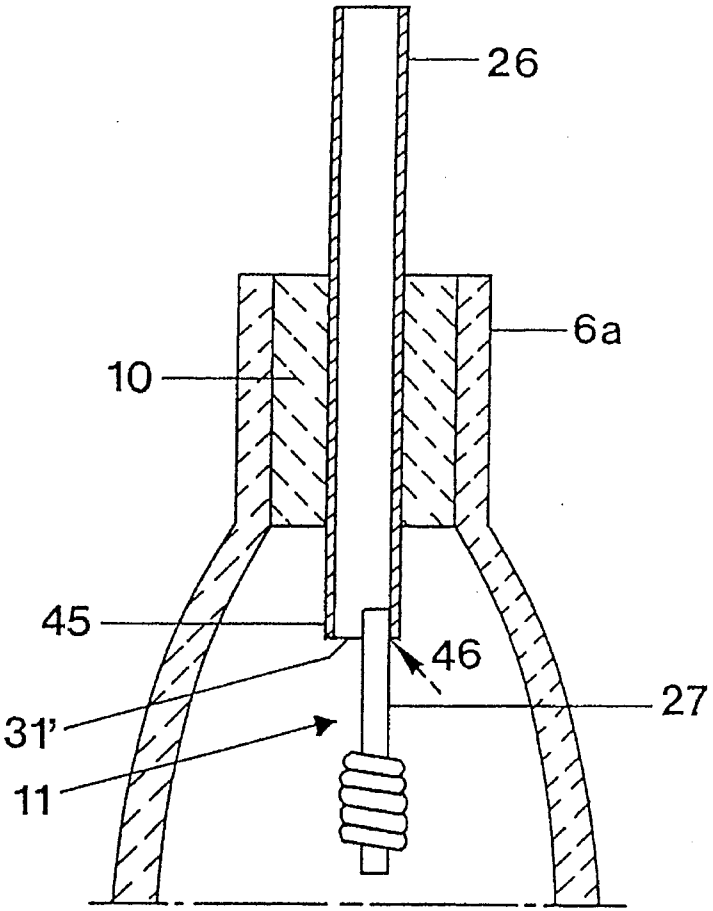

A particularly simple possibility for securing an electrode in a molybdenum tube is shown in FIGS. 8*a* and 8*b*. First, an electrode 11, with a shaft diameter of 0.5 mm, is introduced into the tube 26 to a depth of approximately 0.8 mm and tacked laterally to the end 45 of the tube 26, for instance by means of a laser beam 46 (this is shown in dashed lines in FIG. 8*a*). The tube 26 has an inside diameter of approximately 1.2 mm and a wall thickness typically of 0.2 mm. After the tube 26 has been secured in the plug 10 and the entire electrode system has been sintered in in the pump end 6*a* of the discharge vessel, along with the closure of the blind end, the filling takes place through the filling opening 31' remaining at the tube end 45 (FIG. 8*a*).

After the filling, similarly to FIG. 5, a filler rod 37' of molybdenum is introduced into the tube 26 (FIG. 8*b*); this rod has a recess 47 for the electrode shaft 27. The filler rod (literally "tube") 37' is somewhat shorter than the tube 26, so that it can be welded very simply to the end of the tube remote from the discharge, for instance by an axial incidence of a laser 46".

In this embodiment it is advantageous if on the blind end the electrode is secured in offset fashion to the lead-through, in mirror symmetry with the pump end.

The invention is not limited to the embodiments shown. In particular, characteristics of individual exemplary embodiments may be combined with one another. For instance, in all the exemplary embodiments a filler rod may be used, including those with tubes closed by a pinch. In that case, the welding step on the pinched tube end is omitted, as is the step of final sealing on the pinched tube end by means of metal solder. This is possible because there is no necessity during filling for only the filling bore to be present as an opening; any untightness on the pinched tube end at that time is in fact even advantageous for that purpose. The filler rod technique has the substantial advantage that the welding takes place at the rear of the tube end. This point is not only readily accessible but also under substantially less temperature strain than the front tube end, toward the discharge. Moreover, a welded connection is more reliable than a soldered connection.

Figure 9:
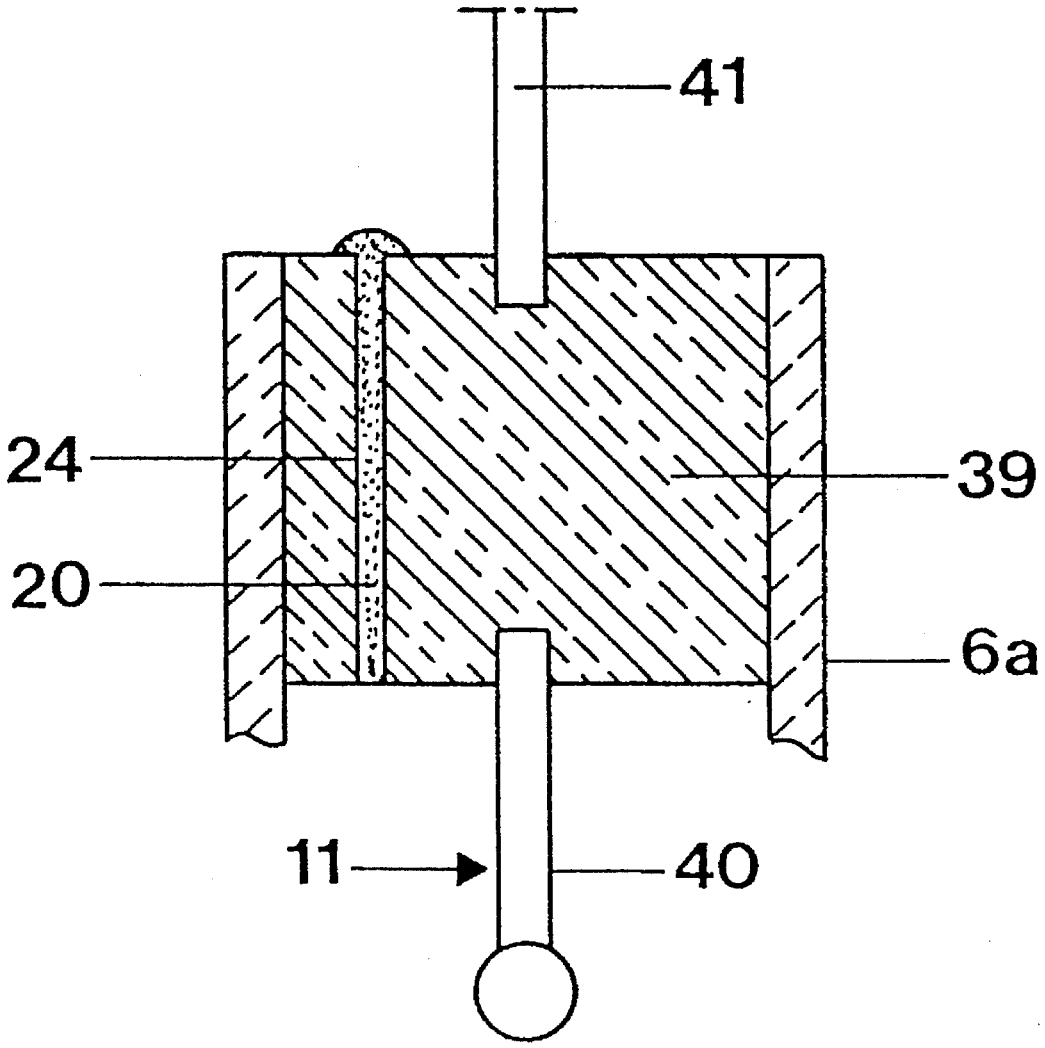

Moreover, the pump end may for instance be equipped with a tubular lead-through, while the blind end has a pronglike lead-through. It is also possible to use a cermet plug, in other words a ceramic plug that contains a small admixture of metal, on the blind end. The production method of the invention is also suitable for a cermet plug 39 on the pump end 6*a*. Then as is known (from European Patent Application 272 930, for instance), a separate lead-through can be dispensed with, because the cermet itself is conductive (FIG. 9). The electrode shaft 40 oriented in the lamp axis is seated directly in the cermet plug 39, which acts as a lead-through, while a power lead 41 is secured to the outer end.

Similarly to FIG. 2, the filling bore 24 is located parallel to the lamp axis in the cermet plug 39. It is closed with glass solder 20. The production method is equivalent to the steps discussed in connection with FIG. 2.

We claim:

1. A method for producing a metal-halide discharge lamp, which has a ceramic discharge vessel (4) defining two ends (6*a*, 6*b*) and enclosing a discharge volume, one (6*a*) of said ends defining a pump end, two sealing means, each sealing means closing one of the ends, two electrodes (11) located in the discharge volume;

two electrically conductive ;lead-throughs, one each for one electrode and connecting a respective one of said electrodes through the respective sealing means which are located at said ends (6*a*, 6*b*) of the ceramic discharge vessel (4);

characterized by the following steps:

a) producing a first electrode system and a second electrode system, at least one of said electrode systems comprising one of the electrodes (11) and one of the sealing means, including one of the lead-throughs;

b) equipping the two ends (6*a*, 6*b*) each with a respective electrode system;

c) sealing off the two ends by heating, while leaving open, in the vicinity of the first or pump end (6*a*), a filling bore (15; 24; 29; 31; 31'; 36) which connects the discharge volume to an external space and sealing off the second end (6*b*) completely as a blind end;

d) evacuating and filling the discharge volume through the filling bore (15; 24; 29; 31; 31': 36); and in the filling process introducing a solid body containing metal halide into the discharge volume:

e) closing the filling bore (15: 24; 29; 31; 31'; 36) and sealing the discharge volume in gas-tight fashion by slowly heating the region of the bore over a large surface area.

2. The method of claim 1, characterized in that the filling bore (15) is located in the side wall of the discharge vessel (4), in the vicinity of the pump end (6*a*).

3. The method of claim 1, characterized in that the filling bore (24; 29; 31; 31'; 36) is located in the sealing means.

4. The method of claim, 1, characterized in that the sealing means is an electrically conductive plug (39), which at the same time performs the function of a lead-through.

5. The method of claim 1, characterized in that the heating is effected by means of a flared laser beam.

6. The method of claim 1, characterized in that the filling bore (15; 24) is covered by a high-melting-point ceramic or glass solder composition (20) in initially solid state, said composition melting upon being heated and sealing off the filling bore, said bore acting as a capillary.

7. A method for producing a metal-halide discharge lamp, which has a ceramic discharge vessel (4) defining two ends (6*a*, 6*b*) and enclosing a discharge volume, one (6*a*) of said ends defining a pump end, two sealing means, each sealing means closing one of the ends, two electrodes (11) located in the discharge volume;

two electrically conductive lead-throughs, one each for One electrode and connecting a respective one of said electrodes through the respective sealing means which are located at said ends (6a, 6b) of the ceramic discharge vessel (4);

characterized by the following steps:

a) producing a first and a second electrode system at least one of said Systems comprising one of the electrodes (11) and one of the sealing means, including one of the lead-throughs;

b) equipping the two ends (6a, 6b) each with a respective electrode system;

c) sealing off the two ends by heating, while leaving open, in the vicinity of the first or pump end (6a), a filling bore (15; 24; 29; 31; 31'; 36) which connects the discharge volume to an external space and completely sealing off the second end (6b) as a blind end;

d) evacuating and filling the discharge volume through the filling bore (15; 24; 29; 31; 31'; 36); and in the filling process introducing a solid body containing metal halide into the discharge volume;

wherein said one Of the lead-throughs connected to said one electrode is a separate part which comprises at least one of the metals molybdenum, tungsten, rhenium; niobium, tantalum;

wherein said one sealing means is a ceramic plug surrounding said one of the lead-throughs, the filling bore being located in the ceramic plug (10); and wherein a high melting point ceramic or glass solder composition (20) is provided, initially in solid state, covering the filling bore: and e) closing the filling bore (15; 24; 29; 31: 31'; 36) and sealing the discharge volume in gas-tight fashion, by melting said composition by being heated and sealing off the filling bore, said filling bore acting as a capillary.

8. A method for producing a metal-halide discharge lamp, which has a ceramic discharge vessel (4) defining two ends (6a, 6b) and enclosing a discharge volume, one (6a) of said ends defining a pump end, two sealing means, each sealing means closing one of the ends, two electrodes (11) located in the discharge volume;

two an electrically conductive lead-throughs, one each for one electrode and connecting a respective one of said electrodes through the sealing respective means which are located at said ends (6a, 6b) of the ceramic discharge vessel (4);

characterized by the following steps:

a) producing a first and a second electrode system at least one of said systems comprising one of the electrodes (11) and one of the sealing means, including one of the lead-throughs;

b) equipping the two ends (6a, 6b) each with a respective electrode system;

c) sealing off the two ends by heating, while leaving open, in the vicinity of the first or pump end (6a), a filling bore (15; 24; 29; 31; 31'; 36) which connects the discharge volume to an external space and completely sealing off the second end (6b) as a blind end;

d) evacuating and filling the discharge volume through the filling bore (15; 24; 29; 31: 31'; 36): and in the filling process introducing a solid body containing metal halide into the discharge volume;

e) closing the filling bore (15; 24; 29; 31; 31'; 36) and sealing the discharge volume in gas-tight fashion, wherein said one of the lead-throughs connected to said one electrode is a separate part which comprises at least one of the metals molybdenum, tungsten, rhenium; niobium, tantalum;

wherein said one of the lead-throughs is formed as a tube (26, 33) or prong (9, 21);

wherein said one sealing means is a ceramic plug (10) surrounding said one of the lead-throughs and wherein said one of the thread-throughs is a tube (26; 33), and the filling bore (31; 31'; 36) is located in a portion of said one of the leadrthroughs oriented and open towards the discharge volume.

9. The method of claim 8, characterized in that method step e) comprises:

filling of a high-melting-point metal solder (42) into said one of the lead-throughs (26; 33); and briefly locally heating of the solder (4) to melting temperature for melting the solder and sealing off the filling bore (31; 36).

10. The method of claim 8, characterized in that method step e) comprises: briefly locally heating said one of the lead-throughs (26; 33) in the region of the filling bore, and melting the tube material itself and sealing off the filling bore.

11. The method of claim 8, characterized in that the step e) includes brief local heating; and the brief local heating is effected by .use of a focused laser beam (46), and further comprises entering the laser beam (46) into said one of the lead.. throughs (26; 33) along a tube axis thereof from an outer open end.

12. The method of claim 8, characterized in that the filling bore (24; 29; 31; 31') is either located, in the vicinity of the end .of Said tube (45), in the side wall of the tube, or is formed by a still-open portion ( 31; 31' ) of the end of said tube (45).

13. The method of claim 8, characterized in that method step e) comprises :

introducing a filler bar (37; 37'), adapted to the inside diameter of the tube into the tube ( 26 ) , whereby the filler bar (37; 37' ) covers the filling bore (29; 31'); and gas-tightly sealing the outer tube end to the filler bar (37, 37') by joining the outer tube end to the filler bar.

14. The method of claim 8, characterized in that in method step a), said one of the electrodes (11) is secured to the tubular lead-through (26: 33) by the following steps:

i) furnishing a tube (26; 33) and a rod-shaped electrode shaft (27; 32) of high-melting-point metal, wherein the diameter of the shaft (27; 32) is considerably less than the inside diameter of the tube (26; 33);

ii) introducing the electrode shaft (27; 32) into an open end (45) of the tube (26;33);

iii) tacking the electrode shaft (33) to the tube end (45), and, optionally, iv) when producing the filling bore (24: 29; 31; 31'; 36)

15. The method of claim 14, characterized by at least one of the steps:

in step i) positioning the electrode shaft and the tube such that the electrode shaft (27) is located laterally offset from the tube axis;

in step iii) tacking the electrode shaft (27) directly to the inner wall of the tube (26);

in step iv) forming the filling bore (31; 31') by a portion of the open end (45) of the tube (26) that remains after the shaft has been introduced.

16. The method of claim 15, characterized by at least one of the following steps:

in step ii) locating a space-saver (30) for the filling bore (30), parallel to the electrode shaft, and introducing said space-saver simultaneously with the shaft (27) into the tube end (45);

deforming the tube by pinching the tube end (45) about the shaft (27) and about the space-saver (30); and in step iv) removing the space-saver (30) from the tube end (45) before or after step iii) to leave a filling opening (31).

17. The method of claim 16, characterized in that said one of the tubular lead-throughs (26; 33 comprises a brittle metal, including the step of heating the tube (26; 33) initially to 400° C. prior to all the deforming steps of the tube.

18. The method of claim 14, characterized by the steps of :

in step i) positioning the shaft and the tube such that the electrode shaft (27; 32) is located centered with respect to the tube axis;

in step iii) prior to the tacking, carrying out the steps of:

deforming one of the two tacking partners, formed by the tube end and the electrode shaft, to provide a loose contact between these two tacking partners;

after the tacking, optionally, closing the tube (45) in gas-tight fashion by supplying heat ;

in step iv) forming the filling bore (24; 29; 36') in the side wall of the tube in the vicinity of the tube end (45).

19. The method of claim 18, characterized by:

effecting the deforming by pinching the tube end (45) about the electrode shaft (27) by means of pinching means (44).

20. The method of claim 18, wherein, after tacking, the tube is closed gas-tightly by welding.

21. The method of claim 18, characterized by:

carrying out the deforming and tacking steps before method step ii); and carrying out the deformation step by rounding one end (35) of the electrode shaft (32) by melting it back, so that the diameter of the thus rounded end (34) of the shaft (32) is adapted to the inside diameter of the tube (33).

22. The method of claim 21, wherein, in step iv), the filling bore (36) is formed in the tube (3) close to the rounded end (34) of the shaft; and essentially solid fill material is introduced into the discharge volume through said tube and filling bore, essentially by gravity.

* * * * *